United States Patent [19]

Childs et al.

[11] 3,981,783

[45] Sept. 21, 1976

[54] ELECTROCHEMICAL FLUORINATION PROCESS UTILIZING EXCESS CURRENT AND HYDROGEN ADDITION

[75] Inventors: William V. Childs; Harold C. Walters, both of Bartlesville, Okla.

[73] Assignee: Phillips Petroleum Company, Bartlesville, Okla.

[22] Filed: June 23, 1975

[21] Appl. No.: 589,738

[52] U.S. Cl. ..... 204/59 F

[51] Int. Cl.[2] ..... C25B 3/08

[58] Field of Search ..... 204/59 F

[56] References Cited

UNITED STATES PATENTS 3,298,940 1/1967 Ashley et al. ..... 204/62

3,511,760 5/1970 Fox et al. ..... 204/59 F

*Primary Examiner*—R. L. Andrews

[57] ABSTRACT

In an electrochemical fluorination process, feedstock is introduced near the bottom end of a porous carbon anode and an excess of electric current is utilized so as to generate excess free fluorine. Hydrogen is introduced at a point near the top of the anode, but below the level of the electrolyte. The net effect of these steps is to give smoother operation with longer anode life.

8 Claims, 3 Drawing Figures

ELECTROCHEMICAL FLUORINATION PROCESS UTILIZING EXCESS CURRENT AND HYDROGEN ADDITION

BACKGROUND OF THE INVENTION

The invention relates to electrochemical fluorination of a fluorinatable feedstock utilizing a porous carbon anode.

It is known in the art to fluorinate numerous organic and inorganic materials by passing same through an electrolysis cell containing a hydrogen fluoride-containing electrolyte. In a preferred embodiment of this known process, the fluorination reaction is carried out within the pores of a porous carbon anode probably as a result of a three phase contact between the anode, the electrolyte, and the feedstock essentially within the confines of the anode.

The art has considered it essential to avoid excess current because of the belief if current were excessive (or the feedstock rate too low), excess free fluorine would be generated, which would react violently and disrupt the operation. It has been found, however, that operating with excess current in an operation using a porous carbon anode in fact enhances the smoothness of the electrochemical fluorination with some feedstocks, although it does result in an early deterioration of the porous carbon anode.

SUMMARY OF THE INVENTION

It is an object of this invention to provide an improved electrochemical fluorination process;

it is a further object of this invention to provide a smoother electrochemical fluorination process through the use of excess current; and it is yet a further object of this invention to extend the useful life of porous anodes in an electrochemical fluorination process.

In accordance with this invention, fluorinatable feedstock is passed into a porous carbon anode at a point near the bottom end thereof in an electrolysis cell containing an essentially anhydrous HF electrolyte. An excess current is passed through the cell with hydrogen being introduced into an upper portion of said anode at a point below the electrolyte level in the cell.

BRIEF DESCRIPTION OF THE DRAWINGS

In the drawings, forming a part hereof, wherein like parts like reference characters denote like parts in the various views.

DESCRIPTION OF THE PREFERRED EMBODIMENTS

Figure 1:
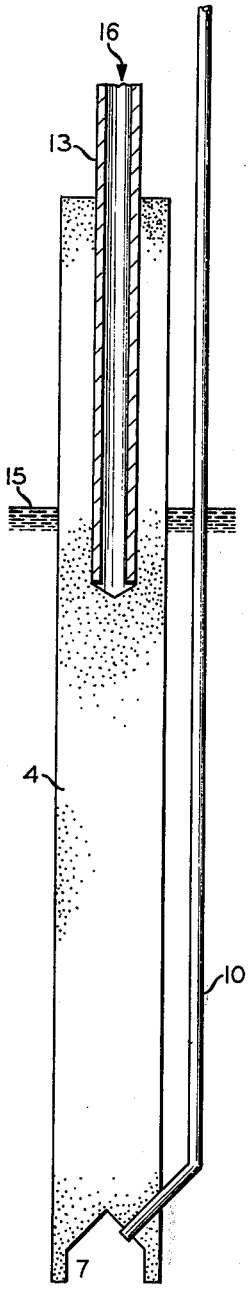
FIG. 1 is a schematic representation of an anode for use in the instant invention.

This invention pertains to the electrochemical fluorination of fluorinatable feedstocks utilizing porous carbon anodes which is broadly disclosed in Fox et al U.S. Pat. No. 3,511,760, the disclosure of which is hereby incorporated by reference. In accordance with the improvement of this invention, the process is carried out under conditions which produce fluorine in excess of that required to completely fluorinate the feedstock. Hydrogen is added near the top of the anode to react with the excess fluorine; suprisingly, this hydrogen addition has been found to lengthen service life of the anode while still giving the improved operating performance which results from the excess current.

Carrying out the electrochemical fluorination with a deficiency of feedstock, i.e. with excess current, can provide significant advantages in many instances, particularly when relatively heavy feedstocks are used or when perfluorinated products are desired.

It is essential when operating in accordance with this invention to pass the stream of hydrogen into the upper portion of the submerged part of the porous carbon anode while simultaneously passing the fluorinatable feedstock into the lower portion and while operating with excess current. The excess fluorine equivalents thus produced react with cathodic hydrogen and the hydrogen introduced into the anode to regenerate hydrogen fluoride and thus this fluorine is not lost.

In an electrochemical process, two Faradays are required to convert one

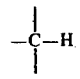

group to a

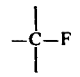

group. Since the passage of 26.8 amperes of current for one hour results in the transfer of one Faraday, two Faradays would be transferred by the passage of 53.6 amperes of current in an hour's time.

Thus, an ethane feedstock, for instance, in the prior art electrochemical fluorination process operating at 53.6 amperes per hour must be fed to the cell at a rate of not less than 1/6 mol/hour so that the hydrogen equivalents in the feedstock just equal or exceed the equivalents of fluorine generated electrolytically. The following equations are illustrative for ethane feedstock:

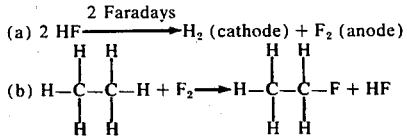

Conversely, the present invention teaches that in an electrochemical fluorination process utilizing, e.g., ethane feedstock and a current of 53.6 amperes per hour, the ethane feed is supplied to the cell at less than 1/6 mol/hour (ethane contains 6 replaceable hydrogens/mol) so that the hydrogen equivalents supplied to the cell in an hour are less than the equivalents of fluorine generated electrolytically in that same time period. By a similar analysis, the lower feedstock rate for fluoroform ($CHF_3$) in the inventive process would be less than one mol per hour with an operating current of 53.6 amperes per hour.

Very few organic compounds are resistant to fluorination. Consequently, a wide variety of feed materials, both normally liquid and normally gaseous compounds, can be used as feedstocks in this process. Generally speaking, desirable organic starting materials which can be used are those containing from 2 to 12, preferably 2 to 10 carbon atoms per molecule. However, reactants which contain less than 2 or more than 12 carbon atoms can also be used. Some general types of organic starting materials which can be used include among others, the following: alkanes, alkenes, alkynes, amines, ethers, esters, acid halides, ketones, mercaptans, nitriles, alcohols, aromatic compounds, and partially halogenated compounds. It will be understood that the above-named types of compounds can be either straight chain, branched chain, or cyclic compounds.

Organic compounds which are normally gaseous or which can be introduced in gaseous state into the pores of a porous anode under the conditions employed in the electrolysis cell, and which are capable of reacting with fluorine, are presently preferred as starting materials in the practice of the invention to produce fluorine-containing compounds. However, it is within the scope of the invention to utilize starting materials which are introduced into the pores of the anode in liquid state. If desired, suitable feed materials having boiling points above cell operating temperatures can be passed into the pores of the porous anode in gaseous state by utilizing a suitable carrier gas. Thus, a suitable carrier gas can be saturated with the feed reactant (as by bubbling said carrier gas through the liquid reactant), and then passing the saturated carrier gas into the pores of the porous anode. Suitable carrier gases include the inert gases such as helium, xenon, argon, neon, krypton, nitrogen, etc. It is also within the scope of the invention to utilize normally gaseous materials such as hydrocarbons containing from 1 to 4 carbon atoms as carrier gases. These latter gases will react, but in many instances this will not be objectionable. It is also within the scope of the invention to utilize the above-described carrier gases, and particularly said inert gases, as diluents for the feedstocks which are normally gaseous at cell operating conditions.

Since fluorine is so reactive, no list of practical length could include all starting materials which can be used in the practice of our invention. However, representative examples of the above-described starting materials include, among others, the following: methane; ethane; propane; butane; isobutane; pentane; n-hexane; n-octane; cyclopropane; cyclopentane; cyclohexane; cyclooctane; carbon monoxide; 1,2-dichloroethane; 1-fluoro-2-chloro-3-methylheptane; ethylene, propylene; cyclobutene; cyclohexene; 2-methylpentene-1; 2,3-dimethylhexene-2; butadiene; vinyl chloride; 3-fluoropropylene; acetylene; methylacetylene; vinylacetylene; 3,3-dimethylpentyne-1; allyl chloride; methylamine; ethylamine; diethylamine; 2-amino-3-ethylpentane; 3-bromopropylamine; triethylamine; dimethyl ether; diethyl ether; methyl ethyl ether; methyl vinyl ether; 2-iodoethyl methyl ether; di-n-propyl ether; methyl formate; methyl acetate; ethyl butyrate; ethyl formate; n-amyl acetate; ethyl caprate; methyl 2-chloroacetate; hexyl trifluoroacetate; n-octyl trifluoroacetate; acetyl fluoride; hexanoyl fluoride; acetone; 2-butanone; methyl mercaptan; ethyl mercaptan; n-propyl mercaptan; 2-mercaptohexane; 2-methyl-3-mercaptoheptane; acetonitrile; propionitrile; n-butyronitrile; acrylonitrile; n-hexanonitrile; methanol; ethanol; isopropanol; n-hexanol; 2,2-dimethylhexanol-3; n-butanol; ethylenebromohydrin; benzene; toluene; cumene; o-xylene; p-xylene; and monochlorobenzene.

Any cell suitable for continuous electrochemical fluorination can be used in the present invention. Cells particularly useful in the practice of the present invention include those described in U.S. Pat. No. 3,692,660, the disclosure of which is hereby incorporated by reference; the anode configuration of the cells suitable for use in the practice of this invention can differ from those of said patent as will be described in detail hereinbelow.

Figure 2:
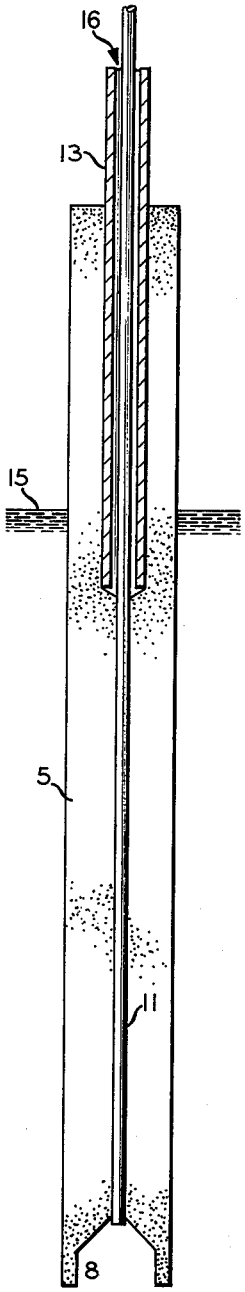
FIG. 2 is a schematic representation of an alternate embodiment of the anode showing introduction of the feed axially through the center of the anode.
Figure 3:
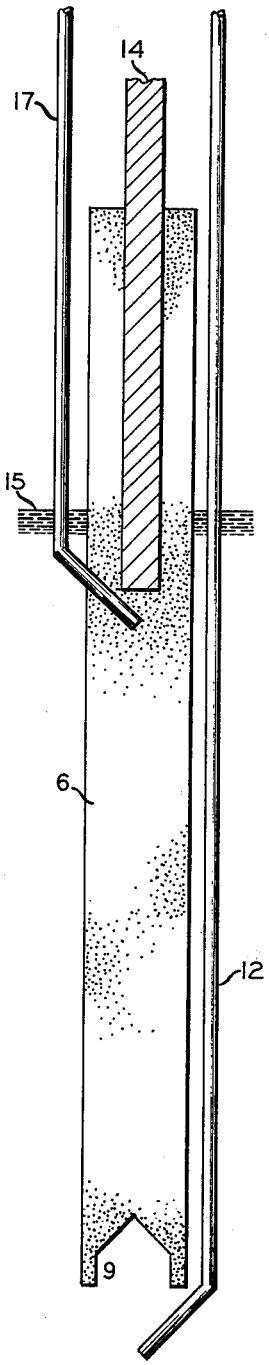
FIG. 3 is a another alternative embodiment of the anode showing introduction of the feed from beneath the anode by a separate tube and showing introduction of hydrogen via a separate tube coming in from the side.

Any porous carbon electrodes (anodes) which provide for introduction of the feedstock at the bottom of said anode and hydrogen near the top of said anode (but below the surface of the electrolyte) are useful in the practice of the present invention. FIGS. 1, 2 and 3 represent types of anodes which are particularly well suited for use in this invention.

The anodes of FIGS. 1, 2 and 3 are constructed from porous carbon having a relatively uniform pore size throughout. The average pore diameter will generally be in the range 1 to 150 microns diameter, preferably between 40 and 140 microns and still more preferably between 50 and 120 microns. The pore sizes depend somewhat on the depth of immersion of the electrode in the electrolyte with deeper immersions requiring somewhat smaller pores. Generally the permeability of the porous carbon will be in the range of 0.5 to about 75 darcys with a preferred range of 5 to 75 and a more preferred range of 10 to 70 darcys. In general the total porosity of the porous carbon will be in the range of about 15 to about 60 percent.

Referring now to FIGS. 1, 2 and 3, there is shown in schematic representation anodes, the bodies 4, 5 and 6 of which are generally cylindrical in shape fashioned from the above described porous carbon. In the bottom of the anode bodies 4, 5 and 6 are cavities 7, 8 and 9 into which feedstock is introduced through feed conduits 10, 11 and 12. As can be seen, there are shown three alternative means for introducing the feed into the cavity and thence into the pores of the anode. Anodes employing the feed conduit shown in FIG. 3 are utilized when it is undesirable to perforate the lower portion of the anode to install a feed conduit or when physical contact of the anode body with the feed conduit is not desired. Current collector 13 is a metal tube embedded in the upper portion of bodies 4 and 5 in the embodiments shown in FIGS. 1 and 2. Solid current collector 14 is a solid metal piece embedded in the upper portion of body 6 in the embodiment shown in FIG. 3. Hydrogen is supplied to the upper portion of the anodes through hydrogen conduits 16 in the embodiments shown in FIGS. 1 and 2 and through conduit 17 in the embodiment of FIG. 3. Hydrogen conduits 16 are, in reality, passageways extending the length of tubular current collectors 13, whereas hydrogen conduit 17 is a tube which penetrates anode body 6 and introduces hydrogen into the porous carbon at a point below solid current collector 14. When placed in position in the above-described cells, the anodes are immersed in electrolyte to level 15. Thus the upper end surface of the porous anode which is above the level of the electrolyte provides a means of exit for the unreacted feed and reaction products from the porous carbon anode, whereas the surfaces of cavities 7, 8 or 9 provide means of entrance for the feedstock into the porous carbon anode.

Other aspects of the cell apparatus such as cathodes, bus bars, power supplies, etc., are conventional and are described in other electrochemical processes.

The electrochemical process of the invention is carried out in a medium of hydrogen fluoride electrolyte. Although said hydrogen fluoride electrolyte can contain small amounts of water, such as up to about 5 weight percent, it is preferred that said electrolyte be essentially anhydrous. The hydrogen fluoride medium is consumed in the reaction and must be either continuously or intermittently replaced in the cell.

Pure anhydrous liquid hydrogen fluoride is nonconductive. The essentially anhydrous liquid hydrogen fluorides described above have a low conductivity which, generally speaking, is lower than desired for practical operation. To provide adequate conductivity in the electrolyte, and to reduce the hydrogen fluoride vapor pressure at cell operating conditions, an inorganic additive can be incorporated in the electrolyte. Examples of suitable additives are inorganic compounds which are soluble in liquid hydrogen fluoride and provide effective electrolytic conductivity. The presently preferred additives are the alkali metal (sodium, potassium, lithium, rubidium, and cesium) fluorides and ammonium fluoride. Other additives which can be employed are sulphuric acid and phosphoric acid. Potassium fluoride, cesium fluoride, and rubidium fluoride are the presently preferred additives. Potassium fluoride is the presently most preferred additive. Said additives can be utilized in any suitable molar ratio of additive to hydrogen fluoride within the range of from 1:4.5 to 1:1, preferably 1:4 to 1:2. The presently most preferred electrolytes are those which correspond approximately to the formulas KF.2HF, KF.3HF, or KF.4HF. Such electrolytes can be conveniently prepared by adding the required quantity of hydrogen fluoride to KF.HF (potassium bifluoride). In general, said additives are not consumed in the process and can be used indefinitely. Said additives are frequently referred to as conductivity additives for convenience.

In operation, the feed is generally discharged into a cavity in the bottom of the anode as a gas or liquid where it is absorbed into the porous electrode element. It is to be noted that the temperature of the electrode may be substantially higher than that of the electrolyte. While it is not desired to limit the invention to any theory of operation, it is believed that the electrolyte partially penetrates the electrode through some of the larger pores. The feed material distributes itself throughout the porous electrode and migrates to near the outer surface to form a three-phase boundary of feed, electrolyte, and electrode element, at which point the reaction takes place. The product and unreacted feed, if any, then migrate up to the portion of the electrode element above the electrolyte level where they are collected, without ever having broken out into the bulk of the electrolyte. In some instances, the feed can momentarily be in contact with the bulk of the electrolyte when it is introduced into the cavity.

Generally speaking, the fluorination process can be carried out at temperatures within the range of from −80 to 500° C at which the vapor pressure of the electrolyte is not excessive, e.g., less than 250 mm. Hg. It is preferred to operate at temperatures such that the vapor pressure of the electrolyte is less than about 50 mm. Hg. A presently preferred range of temperature is from about 60 to about 130° C.

Pressure substantially above or below atmospheric can be employed if desired, depending upon the vapor pressure of the electrolyte as discussed above. Generally speaking, the process is conveniently carried out at substantially atmospheric pressure.

Current densities within the range of 30 to 1000, or more, preferably 50 to 500, milliamps per square centimeter of anode geometric surface can be used. The voltage which is normally employed will vary depending upon the particular cell configuration employed and the current density desired. Voltages in the range of 4 to 12 volts are typical. Generally speaking, the maximum normal voltage will not exceed 20 volts per unit cell. The term "anode geometric surface" refers to the outer geometric surface area of the porous element of the anode which is exposed to the electrolyte and does not include the pore surfaces of said porous element.

As described above the rate of introduction of the feedstock into the porous carbon anode is dependent upon the electrical current flow through the anode. Since a current of 53.6 amps for one hour (i.e., 2 faradays) is necessary to convert one equivalent of C-H bonds to one equivalent of C-F bonds then the practice of this invention requires that the number of hydrogen equivalents in the feedstock introduced into the anode per hour be less than one-half the number of faradays passing through the anode per hour. In other words, for every two faradays per hour (53.6 amps) of current the feed rate will be less than that providing one hydrogen equivalent per hour.

With feeds containing olefinic and/or acetylenic unsaturation wherein fluorine addition, as well as fluorine substitution of hydrogen atoms, takes place, the theoretical amount of current is, of course, computed to include two Faradays per double (olefinic) bond and four Faradays per triple (acetylenic) bond. Thus for simplicity in calculating the theoretical amount of current (hence fluorine) required to completely fluorinate a given feedstock, each double bond is considered to correspond to one hydrogen (C-H bond) equivalent and each triple bond is considered to correspond to two hydrogen (C-H bond) equivalents. Similarly, a feed such as CO which also adds fluorine can be considered to contain the equivalent of a double bond and thus corresponds to one hydrogen (C-H bond) equivalent.

Feed rates in the range of 0.1 to 0.99 hydrogen equivalents in feedstock per hour for every 53.6 amps of electrical current are within the scope of this invention. A preferred range of feed rates is from 0.2 to 0.75 hydrogen equivalents in feedstock per hour for every 53.6 amps of electrical current.

The rate of introduction of hydrogen into the anode is dependent on the electrical current flow through the anode and the degree of conversion of fluorine to fluorinated products. Sufficient hydrogen should be present in the anode near the bottom of the current collector to react with all of the fluorine which is in excess over that required to react with feedstock. If such excess fluorine is not consumed in reaction with cathodic hydrogen (hydrogen produced at the cathode) or added hydrogen in the anode, rapid deterioration of the anode, current collector and feedstock conduit can occur. Hence it is desirable to add 0.3 to about 20 moles of hydrogen per mole of fluorine generated (or, i.e., per 2 faradays). A preferred range of hydrogen feed rate is from 0.5 to 5 moles of hydrogen per mole of fluorine generated.

EXAMPLE

The following inventive run and comparative run were carried out for the electrochemical fluorination of n-hexyl trifluoroacetate prepared from n-hexanol and trifluoroacetyl fluoride.

Inventive Run

The electrolytic cell excluding the anode employed in this run was generally as described in said U.S. Pat. No. 3,692,660, the only modification being a cell employing a single electrode tube instead of the plurality of tubes shown in that patent.

The porous carbon anode used in conjunction with the above described cell was fashioned from a porous carbon block (Grade B from Union Carbide) having a density of 1.04 gm/cc, an average pore diameter of 0.058 mm, an average porosity of 48 percent and an average permeability of 12 darcys. The cylindrical anode fashioned as in FIG. 2 was 35.6 cm long and 3.5 cm in diameter with a copper tube (1.27 cm diameter) extending 12.7 cm down the center of the anode from the top and a 3.18 mm diameter polytetrafluoroethylene tube extending through the copper tube and the center of the anode into the cavity in the bottom of the anode.

The electrolyte was essentially anhydrous liquid hydrogen fluoride containing potassium fluoride as conductivity additive in the molar ratio of KF.2HF.

The electrochemical fluorination was carried out under conditions recorded in Table I. After 51.5 hours of continuous operation the anode was still operating properly but was removed from service for inspection and to change runs. No visible deterioration of the anode was observed. During this period of operation 456 gm of feed was introduced into the anode and 767 gm of effluent was collected from which approximately 285 gm (~50 percent yield) of crude perfluorohexanoyl fluoride was obtained.

Comparative Run

The same electrolytic cell excluding anode as employed in the Inventive Run was used in this Comparative Run. The porous carbon anode was constructed from a block of porous carbon (B303 from Great Lakes Carbon Co.) having an average pore diameter of 0.089 mm, an average porosity of 46 percent and an average permeability of 18 darcys. The cylindrical anode, fashioned as shown in U.S. Pat. No. 3,711,396, FIG. 13, was 35.6 cm long and 3.5 cm in diameter with a solid copper current collector (1.27 cm diameter) extending 12.7 cm down the center of the anode from the top and a 3.18 mm diameter polytetrafluoroethylene feed conduit extending along the outside of the anode and penetrating the anode wall to enter the cavity in the base of the anode.

The electrolyte was as described in the Inventive Run.

The electrochemical fluorination was carried out under conditions recorded in Table I. After 14 hours of operation on hexyl trifluoroacetate feedstock interrupted by overnight operation on ethane as feedstock (fluorination of ethane was considered very mild and resulted in substantially less anode deterioration than hexyl trifluoroacetate) the anode failed. Subsequent examination of the anode revealed a fracture in the porous carbon near the current collector. During this period of operation 183 gm of feed was introduced into the anode and 423 gm of effluent was collected from which crude perfluorohexanoyl fluoride (approx. 70 percent yield) was obtained.

Table I

| Run | Temp. °C | Volts | Amps | $H_2$ | Feed Rate gm/hr | Time, hr. | Anode Operation After Run |
|---|---|---|---|---|---|---|---|
| Inv. | 99–105 | 7.65–7.9 | 80.0–80.4 | 20 l/hr | 7.6– 9.6 | 51.5 | Operating properly |
| Comp. | 113–119 | 7.8 –8.6 | 80.0–80.6 | 0 | 9–17 | 14 | Failed |

The above data illustrate the improved service life of the anode accruing from the practice of this invention. The lower temperature employed in the Inventive Run would be expected to contribute to the longer service life but the observation that the anode was still operating properly after more than fifty hours of continuous operation was unexpected. On the other hand, the higher feed rates utilized in the comparative run would be expected to result in higher consumption of the generated free fluorine and, hence, result in extended service life of the anode. The reason for apparent lower yield of perfluorohexanoyl fluoride from the inventive run than the comparative run is not currently understood, though it should be noted that since product was not purified and only crude product was obtained, yield data are only approximate.

While this invention has been described in detail for the purpose of illustration, it is not to be construed as limited thereby but is intended to cover all changes and modifications within the spirit and scope thereof.

What is claimed is:

1. A process for the electrochemical fluorination of a fluorinatable feedstock comprising:

passing an electric current through a current-conducting essentially anhydrous liquid, hydrogen fluoride electrolyte contained in an electrolysis cell containing a cathode and a porous carbon anode;

introducing said feedstock into said anode at a point near a bottom thereof and contacting said feedstock with said electrolyte within pores of said anode to thus at least partially fluorinate at least a portion of said feedstock, said current being passed in an amount sufficient to generate an excess of free fluorine;

introducing hydrogen into said anode at a point near an upper end thereof but below a level of said electrolyte and thus into contact with said free fluorine; and recovering fluorinated product, unreacted feedstock, and HF.

2. A method according to claim 1 wherein said electrolyte is KF.2HF.

3. A method according to claim 2 wherein said feedstock is introduced in an amount within the range of 0.25 to 0.75 feedstock hydrogen equivalent per hour per 53.6 amperes of current, a current density of 30 to 1000 milliamps per square centimeter of anode geometric surface is utilized and a voltage within the range of 4 to 20 volts is utilized, said feedstock being n-hexyl trifluoroacetate.

4. A method according to claim 3 wherein said hydrogen is introduced in an amount within the range of 0.3 to 20 mols of hydrogen for each two faradays of electricity.

5. A method according to claim 1 wherein said feedstock is introduced in an amount within the range of 0.1 to 0.99 feedstock hydrogen equivalents per hour per 53.6 amperes of current.

6. A method according to claim 1 wherein said feedstock is introduced in an amount within the range of 0.25 to 0.75 hydrogen equivalents per hour per 53.6 amperes of current, a current density of 30 to 1000 milliamps per square centimeter of anode geometric surface is utilized, and the voltage is within the range of 4 to 20 volts.

7. A method according to claim 1 wherein said feedstock is n-hexyl trifluoroacetate.

8. A method according to claim 1 wherein said hydrogen is introduced in an amount within the range of 0.3 to 20 mols of hydrogen for each two faradays of electricity.

* * * * *